US006493289B2

(12) United States Patent
Kitaori et al.

(10) Patent No.: US 6,493,289 B2
(45) Date of Patent: Dec. 10, 2002

(54) ULTRASONIC CLEANING APPARATUS

(75) Inventors: Noriyuki Kitaori, Utsunomiya (JP); Takahisa Yamashiro, Utsunomiya (JP); Takeshi Miyamura, Utsunomiya (JP); Kiyoteru Osawa, Utsunomiya (JP); Masayasu Sato, Utsunomiya (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/842,909

(22) Filed: Apr. 27, 2001

(65) Prior Publication Data

US 2001/0037537 A1 Nov. 8, 2001

(30) Foreign Application Priority Data

Apr. 28, 2000 (JP) ..... 2000-129587
Apr. 28, 2000 (JP) ..... 2000-130947
Apr. 28, 2000 (JP) ..... 2000-131113

(51) Int. Cl.[7] ..... B08B 7/02; B06B 1/02; A47L 5/00

(52) U.S. Cl. ..... 367/189; 15/379

(58) Field of Search ..... 367/189; 310/328, 310/334; 15/363, 379, 381

(56) References Cited

U.S. PATENT DOCUMENTS 4,111,546 A * 9/1978 Maret ..... 355/15
4,302,485 A * 11/1981 Last et al. ..... 427/57
4,386,256 A * 5/1983 Inoue ..... 219/69 M
5,032,027 A * 7/1991 Berliner, III ..... 366/15
5,998,908 A * 12/1999 Goodson ..... 310/328

FOREIGN PATENT DOCUMENTS

| | | |
|---|---|---|
| JP | A6366372 | 3/1988 |
| JP | A6218337 | 8/1994 |
| JP | A10328472 | 12/1998 |
| JP | A1147061 | 2/1999 |
| WO | A19942555 | 8/1999 |

* cited by examiner

*Primary Examiner*—Ian J. Lobo
(74) *Attorney, Agent, or Firm*—Birch, Stewart, Kolasch & Birch, LLP

(57) ABSTRACT

Provided is a vibrating section having an ultrasonic transducer of piezoelectric elements and a rear ultrasonic horn and a front ultrasonic horn, the horns being joined to the transducer. The ultrasonic transducer has a consumption power set at 8W or less. The ultrasonic horn has a flat front end surface, the area of the front end surface being set at 0.07 to 1 $cm^2$.

16 Claims, 12 Drawing Sheets

FIG.6

| | FRONT END AREA ($cm^2$) | S2/S1 | FLATNESS DEVIATION TOLERANCE (mm) | CLEANING RATE (REFLECTANCE %) | | | | |
|---|---|---|---|---|---|---|---|---|
| | | | | OUTPUT (2W) | OUTPUT (4W) | OUTPUT (8W) | OUTPUT (15W) | OUTPUT (50W) |
| EXPERIMENTAL EXAMPLE A1 | 0.3 | 5.9 | 0.005 | 78 | 81 | 82 | 83 | ------ |
| EXPERIMENTAL EXAMPLE A2 | 0.3 | 5.9 | 0.2 | 72 | 78 | 80 | 80 | ------ |
| EXPERIMENTAL EXAMPLE A3 | 0.5 | 3.0 | 0.05 | 71 | 76 | 77 | 77 | ------ |
| EXPERIMENTAL EXAMPLE A4 | 1.75 | 1.0 | 0.005 | 45 | 47 | 60 | 68 | 80 |
| EXPERIMENTAL EXAMPLE A5 | 1.75 | 1.0 | 1.0 | 40 | 45 | 55 | 66 | 74 |
| EXPERIMENTAL EXAMPLE A6 | 0.71 | 2.5 | 0.05 | 62 | 64 | 66 | 70 | ------ |

FIG.13

| | HORN DIMENSION (mm) | | | BC/3A | 10A/(A+B+C) | AB/2C | S2/S1 | RESONANCE FREQUENCY (kHz) | CLEANING RATE (%) |
|---|---|---|---|---|---|---|---|---|---|
| | A | B | C | | | | | | |
| EXPERIMENTAL EXAMPLE B1 | 33 | 8 | 16 | 1.3 | 5.8 | 8.5 | 5.9 | 50 | 82 |
| EXPERIMENTAL EXAMPLE B2 | 23 | 8 | 7.5 | 0.9 | 6.0 | 12.3 | 5.9 | 70 | 81 |
| EXPERIMENTAL EXAMPLE B3 | 39 | 10 | 39 | 3.3 | 4.4 | 5.0 | 1.8 | 30 | 76 |
| EXPERIMENTAL EXAMPLE B4 | 33 | 8 | 19 | 1.5 | 5.5 | 6.9 | 3.0 | 58 | 80 |
| EXPERIMENTAL EXAMPLE B5 | 45 | 8 | 45 | 2.7 | 4.6 | 4.0 | 5.9 | 42 | 68 |
| EXPERIMENTAL EXAMPLE B6 | 25 | 10 | 40 | 5.3 | 3.3 | 3.1 | 1.8 | 55 | 64 |

FIG.22

| | HORN CONFIGURATION | | | | PIEZOELECTRIC ELEMENT | | APPLIED OUTPUT | CLEANING RATE | UNEVENNESS DEGREE |
|---|---|---|---|---|---|---|---|---|---|
| | LONGER DIMENSION (mm) | SHORTER DIMENSION (mm) | DIMENSION RATIO | (S1) AREA ($mm^2$) | DIAMETER (mm) | (S2) AREA ($mm^2$) | (W) | (%) | (%) |
| EXPERIMENTAL EXAMPLE C1 | 15 | 2.5 | 6 | 37.5 | 15 | 176.7 | 6 | 82 | 5 |
| EXPERIMENTAL EXAMPLE C2 | 15 | 1.5 | 10 | 22.5 | 15 | 176.7 | 8 | 81 | 7 |
| EXPERIMENTAL EXAMPLE C3 | 10 | 3.0 | 3.3 | 30 | 15 | 176.7 | 4 | 80 | 7 |
| EXPERIMENTAL EXAMPLE C4 | 15 | 2.5 | 6 | 37.5 | 20 | 314.0 | 8 | 78 | 6 |
| EXPERIMENTAL EXAMPLE C5 | 20 | 60 | 33 | 120 | 20 | 314.0 | 8 | 77 | 6 |
| EXPERIMENTAL EXAMPLE C6 | 15 | 10 | 15 | 150 | 15 | 176.7 | 8 | 76 | 10 |
| EXPERIMENTAL EXAMPLE C7 | 15 | 15 | 1 | 176.7 | 15 | 176.7 | 8 | 72 | 12 |
| EXPERIMENTAL EXAMPLE C8 | 25 | 5 | 5 | 125 | 25 | 490.6 | 8 | 73 | 13 |
| EXPERIMENTAL EXAMPLE C9 | 30 | 10 | 3 | 300 | 15 | 176.6 | 8 | 68 | 13 |
| EXPERIMENTAL EXAMPLE C10 | 25 | 5 | 5 | 125 | 25 | 490.6 | 50 | 82 | 5 |

ULTRASONIC CLEANING APPARATUS

BACKGROUND OF THE INVENTION

1. Field of the Invention

The present invention relates to an ultrasonic cleaning apparatus, and more particularly, to an ultrasonic cleaning apparatus for home use for cleaning fabric or textile goods.

2. Description of the Related Art

Conventional known techniques of cleaning textile goods or the like employing ultrasonic vibration are disclosed in Japanese Patent Laid-Open Publication Nos. Sho-63-66372 and Hei-10-328472, respectively. In the cleaning techniques disclosed in those publications, articles to be cleaned (such as textile goods) are immersed in cleaning fluid and the transducer is also put into the cleaning fluid to transmit ultrasonic vibration generated by an ultrasonic oscillator to the articles, thereby to remove stains or dirty spots adhered to the articles.

SUMMARY OF THE INVENTION

Cleaning machines utilizing ultrasonic as disclosed in the above publications are, however, difficult to operate and difficult to put them into practical use in homes. More specifically, such an ultrasonic cleaning machine requires high electric power enough to obtain good cleaning power. Thus a power source and an ultrasonic vibrating section have relatively large weights, making the machine inconvenient for use.

Generally, an ultrasonic transducer of a higher frequency of the same amplitude provides higher cleaning power. However, at a high frequency, it is difficult to obtain larger amplitude. In this context, in designing an ultrasonic cleaning apparatus, frequency is set in the tradeoff between amplitude and cleaning power.

Conventional cleaning apparatus mostly has a round front end surface. In designing a small ultrasonic cleaning apparatus with a low consumption power usable in homes, it is difficult to provide a round large cleaning area in consideration of output. This reason is that energy per area is reduced to lower performance in removing stains. If the round area is made small, the central part and the peripheral part come into contact with an article to be cleaned for different time periods, which produces unevenness in effect of removing stains according to positions. The unevenness results in reducing its original cleaning effect.

It is therefore an object of the present invention to provide an ultrasonic cleaning apparatus in small size and lightweight, which exerts sufficient effect in ultrasonic cleaning with a low consumption power.

Another object of the present invention is to provide an ultrasonic cleaning apparatus which a housewife safely employs in home.

According to a first aspect of the invention, there is provided an ultrasonic cleaning apparatus including a transducer, for example a piezoelectric element, for generating ultrasonic vibration and a first horn for transmitting the ultrasonic vibration, the first horn being joined to one side of the transducer. The transducer has a consumption power set at 8W or less. The first horn has an area (S1) set at 0.07 to 1 $cm^2$.

Thus in this invention, the area of the first horn set within the prescribed range allows the apparatus to be driven with a low consumption power.

Preferably, a relationship between a second area (S2) of the one side of the transducer and the first area (S1) is $S2/S1 \geqq 3$.

Preferably, the ultrasonic cleaning apparatus further includes a second horn joined to another side of the transducer. the first horn of length A, the transducer of length B and the second horn of length C are set in a relationship of $BC/3A \leqq 10A/(A+B+C) \leqq AB/2C$.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Thus in this invention, the apparatus is efficiently driven with the transducer to which a low consumption power of 8W or less is supplied (the power is supplied to the piezoelectric elements, not to circuits).

Preferably, the first horn has a front end surface with a dimension ratio R, the dimension ratio R being set within range of $3 \leqq R \leqq 10$.

Thus in this invention, the first horn has a flat front end , or front end surface in a rectangular shape, which end is made to form a generally right angle at the main axis with a direction to advance the front end surface contacted to an article to be cleaned, thereby being moved in a wider area to be cleaned. Further the flatness of the front end of the first horn concentrates ultrasonic vibration generated by the transducer on the front end surface, providing highly efficient ultrasonic cleaning with a low consumption power. In this invention, in order to employ without a cord for ease of use and to obtain a high cleaning power at 8W or less which can be supplied with a dry cell or rechargeable battery, the cleaning surface is preferably in a rectangular or elliptic shape.

The words "dimension ratio R" means the ratio in length of a major axis to a minor axis or a longer side to a shorter side of the front end surface in ellipse or rectangle. In an elliptic shape, a shorter diameter is a minor axis and a longer diameter is a major axis. In detail, the longest axis in the major axis direction is the major axis and the longest axis in the minor axis direction is the minor axis.

Preferably, the first horn has a flat front end surface.

Further preferably, the ultrasonic cleaning apparatus further includes a guide cover enclosing the first horn.

BRIEF DESCRIPTION OF THE ACCOMPANYING DRAWINGS

The above and further objects and novel features of the invention will more fully appear from the following detailed description when the same is read in conjunction with the accompanying drawings, in which:

FIG. 6 shows the result of measuring a degree of cleanness in each experimental example;

FIG. 13 shows the result of measuring a degree of cleanness in each experimental example;

FIG. 22 shows the result of measuring a degree of cleanness and a degree of unevenness in the rate of cleanness in each experimental example.

DETAILED DESCRIPTION OF THE PREFERRED EMBODIMENTS

With reference to the accompanying drawings, preferred embodiments of this invention will now be described.

First Embodiment

Figure 1:
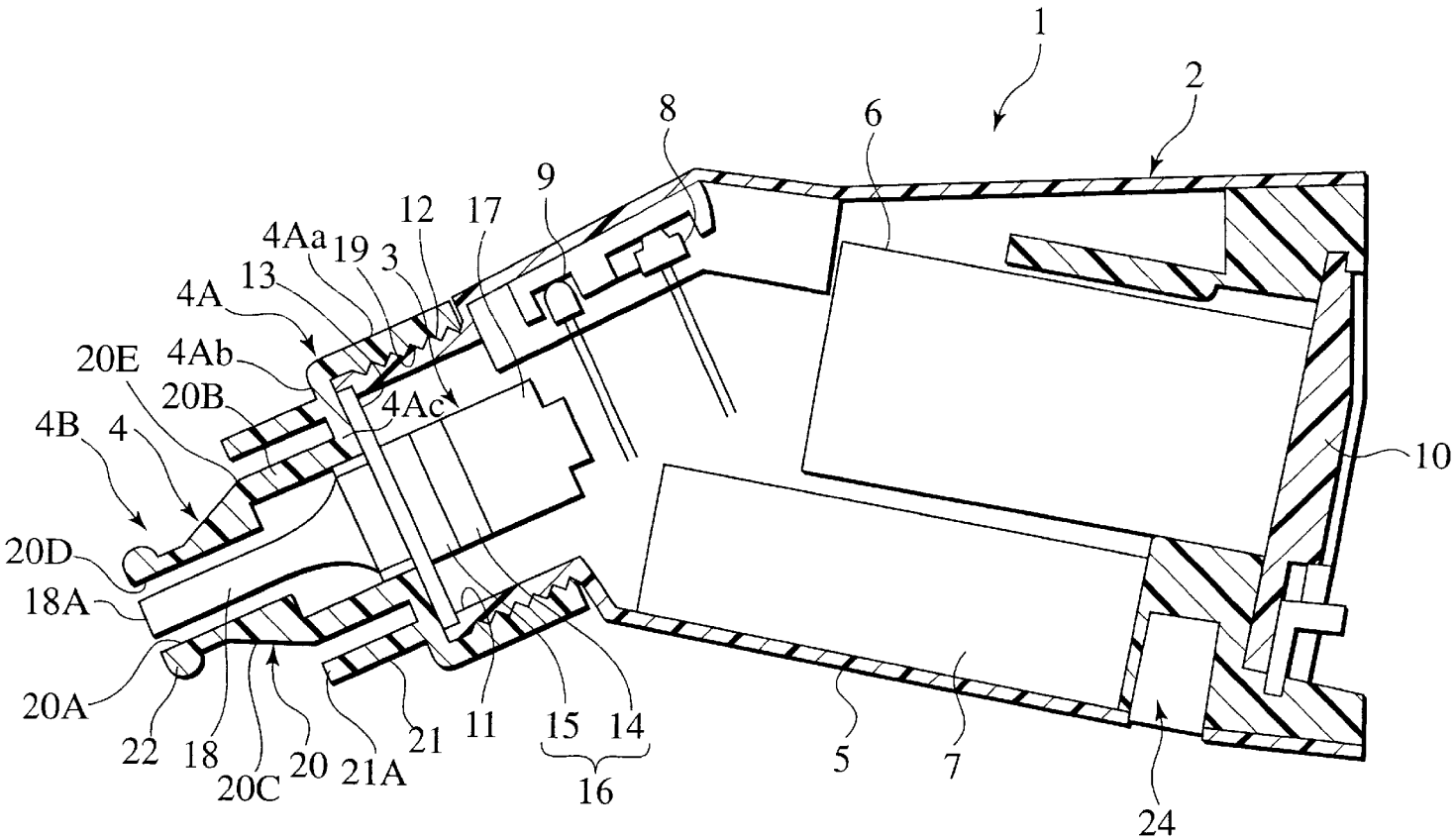
FIG. 1 is a sectional view of an ultrasonic cleaning apparatus according to a first embodiment of the present invention.

FIG. 1 is a sectional view showing an ultrasonic cleaning apparatus 1 according to an embodiment of the present invention. The ultrasonic cleaning apparatus 1 includes generally of an apparatus body 2 as power supply, an ultrasonic vibrating section 3 provided in the body 2 and a cover 4 for guiding an article to be cleaned, the cover 4 enclosing the ultrasonic vibrating section 3.

The body 2, as shown in FIG. 1, has a casing 5 made of resin in a generally cylindrical shape, in which accommodated are a battery space 6, a drive circuit 7, a switch 8 and a light emitting diode 9 serving as a drive indicator. To the rear end of the casing 5 is attached a back lid 10 for closing the battery space 6. In the front part of the casing 5 is supported the vibrating section 3. The front part of the casing 5 is formed in a cylindrical shape, and the peripheral surface of the front part constitutes a male screw 12 to be engaged with the cover 4.

The vibrating section 3 is supported through a flange 13 at a front opening 11 of the casing 5. The vibrating section, 3 includes an ultrasonic transducer 16 of joined piezoelectric elements 14, 15, a rear ultrasonic horn 17 as a second horn in the present invention joined to the rear surface of the transducer 16, and a front ultrasonic horn 18 as a first horn in the present invention of a prescribed length joined to the front surface of the transducer 16. Although the rear horn 17 and the front horn 18 are separated with the transducer 16 therebetween, the two horns constitute an ultrasonic horn (an additional ultrasonic horn will be included to constitute the ultrasonic horn when it is provided at the front side of the front horn 18). The rear horn 17 and the front horn 18 are made of a metal which easily transmits vibration so as to change a vibration of the transducer 16 to a prescribed frequency or to strengthen vibration. The front horn 18 is configured to protrude forwardly from the front end of the casing 5.

In a preferred use of the front horn 18, the front end surface 18A of the horn 18 forms an angle from 70 to 110 degrees with a surface of an article being cleaned. Setting such an angle allows the front end surface 18A in its entirety to provide good transmission of ultrasonic to an article being cleaned. An article to be cleaned is moistened with water or cleaning fluid to surface stains of the article, whereby efficient cleaning is done.

To the piezoelectric elements 14, 15 are connected electrodes (See FIG. 19, electrodes 25, 26, for example) to which power is supplied from a power source. The number of piezoelectric elements to be used can be any, but preferably is 2 or 4. In this embodiment, a position where the flange 13 is attached in the vibrating section 3 is the position where a node of vibration exists, and more specifically, is arranged at the front end of the piezoelectric element 15.

In this embodiment, support is given at a position corresponding to a node of vibration of the ultrasonic horn to obtain a holding structure in which the amount of attenuation of ultrasonic vibration is smaller.

Now an example of the structure of the vibrating section 3 will be described.

For the vibrating section 3 of this embodiment, prepared is a Langevin ultrasonic transducer in which used are cylindrical piezoelectric elements as the piezoelectric elements 14, 15 with lead titanate zirconate ($Pb[Zr \cdot Ti]O_3$), a solid solution of $PbZrO_3$ and $PbTiO_3$, as the main ingredient (each having a diameter of 15 mm, an area of 176.6 $mm^2$ and a thickness of 4 mm with a hole in the center core to be fastened with a bolt. The hole has a diameter of 5 mm. The area mentioned here is calculated with the hole ignored.), which elements being polarized in the thickness direction and held between the rear horn 17 and the front horn 18 made of aluminum at a torque of 50 kg-cm. The length of the front horn 18 is set at 32.8 mm and the rear horn 17 is at 14.3 mm. The diameter of the rear horn 17 is set at 15 mm, the same as the piezoelectric elements 14, 15. The resonant frequency is set at 50 kHz. The front horn 18 has a flat (plane) front end. The tolerance of the flatness is set at 0.005 mm (The flat surface in this embodiment is not limited to that tolerance, but the flatness thereof can be shown with the tolerance as a measure. The words "flat surface" used in this embodiment means a flat surface configured to contact an article to be cleaned, with a tolerance of flatness of 0.2 mm or less. The degree of flatness means the amount of deviation of a flat geometry from a geometrically correct flat surface. The flatness is expressed at a minimum distance between two geometrically parallel planes interposing a flat geometry therebetween (See Japanese Industrial Standard, JIS B 0621).). The front end surface of the front horn 18 is configured to have area S1 of 0.3 $cm^2$, and the piezoelectric elements have area S2 of 1.77 $cm^2$.

Figure 4A:
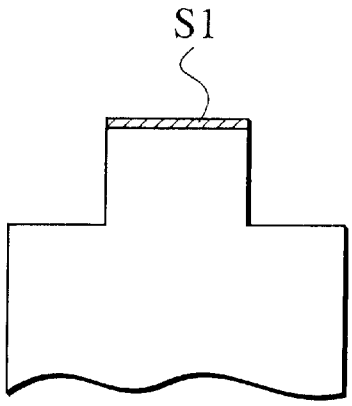
FIGS. 4A and 4B are explanatory views of the area of the front ends of modifications of the front horn of the ultrasonic cleaning apparatus.
Figure 4B:
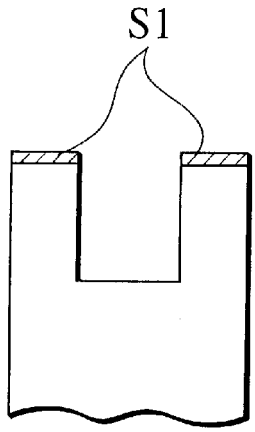
Figure 5:
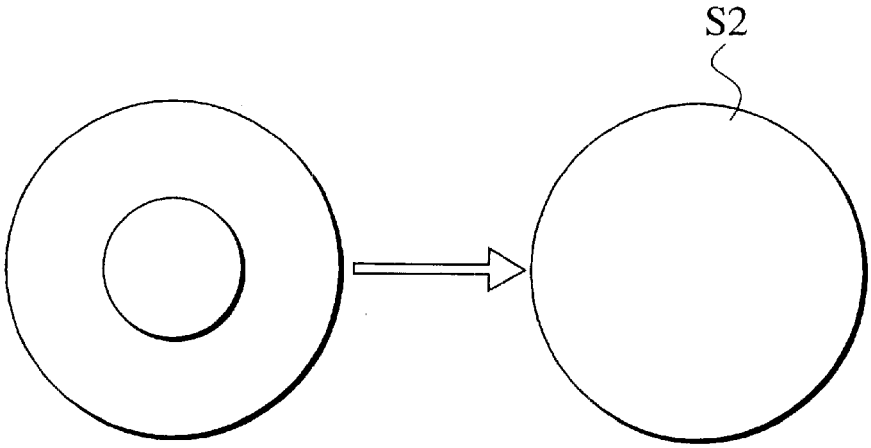
FIG. 5 is an explanatory view of the joined area of a piezoelectric element of the ultrasonic cleaning apparatus.

S1 constitutes the area of the front end of the front horn 18, that is, a cleaning face. When the front horn has a front end as shown in FIG. 4A or 4B, S1 corresponds to the part shown in hatch lines. S2 constitutes the area of each piezoelectric element to be joined with the horn. When the piezoelectric elements have a round hole at its core as shown in FIG. 5, the area S2 is considered without the round hole, that is, the holed surface area is included in S2. That is, S2 has the same area whether a hole is present or not. The area can be determined simply from the diameter of the piezoelectric elements. Further, with respect to the tolerance of the flatness, the front end surface is measured in its entirety in a method as described in JIS B 0621. That is, a deviation of the front end surface as a whole from an ideal plane (theoretical plane) is measured.

The cover 4 is made of synthetic resin in a generally cylindrical shape as shown in FIG. 1. The cover 4 has a rear part 4A with an internal diameter that allows the front part of the casing 5 to be screwed and inserted into. The rear part 4A has an annular engagement part 4A*a* with an internal surface formed as a female screw 19 to be engaged with the male screw 12. The rear part 4A has an annular front end 4A*b* which extends radially inward from the engagement part 4A*a* at its end.

The cover 4 has a front part 4B integral with the rear part 4A. The front part 4B also has a covering member 20 in tube enclosing the front horn 18 protruded from the casing 5, and has a grip member 21 in annulus surrounding the covering member 20 apart therefrom. The covering member 20 extends from the front end 4A*b* at its inner edge 4AC. The grip member 21 extends from the front end 4A*b* at a position radially outward of the covering member 20. The covering member 20 has a base part 20B with generally the uniform external diameter, and a distal part 20C with an external diameter set to be gradually smaller in the forward direction. The base part 20B is substantially equal in length to the distal part 20C and at its end 20E is flush with the grip member 21 at its end 21A. The distal part 20C has an opening rim 20A at its end, which defines an opening 20D.

Figure 3:
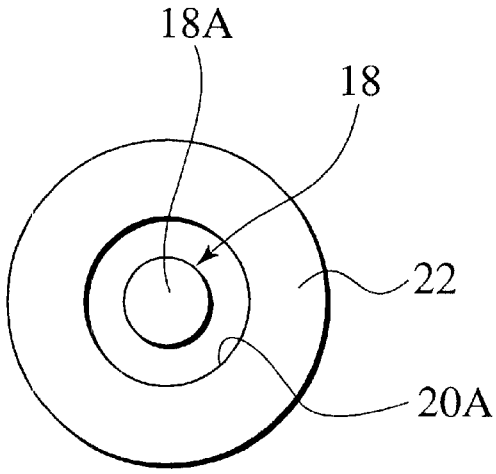
FIG. 3 is a front view of the cover and the front horn of the ultrasonic cleaning apparatus in the first embodiment.

Around the opening rim 20A of the front end of the covering member 20 is formed a ring 22 for guiding an article to be cleaned, the ring having a generally circular shape in cross section and a curved surface. When the rear part 4A of the cover 4 is engaged with the front part of the casing 5, the flange 13 is held between the end surface of the front end opening 11 of the casing 5 and the cover 4, whereby the vibrating section 3 is held. As shown in FIG. 3, the front horn 18 is not in contact with the ring 22 or the cover 20 which surround the horn. This provides a structure which largely prevents the attenuation of ultrasonic vibration of the front horn 18. For example, a non-contact clearance of 0.1 to 8 mm is provided between the horn 18 and the covering member 20 of the cover 4. The cover 4 has a flexural strength of 0.1 kgf/ $mm^2$ ($9.8\times105 N/m^2$) or more.

The outer surface of the ring 22 is curved, the curved surface guiding an article such as clothes to be cleaned. Since the curved surface of the ring 22 smoothly slides on an article being cleaned, it is ensured that the article is made to contact or be opposed to the front end surface 18A of the front horn 18. In this structure, liquid such as cleaning fluid is interposed between an article to be cleaned and the front end surface 18A of the front horn 18, thereby to remove stains off the article in a positive manner. The ring 22 prevents the front horn 18 from contact with fingers of a user by mistake, thus achieving safety.

Figure 2A:
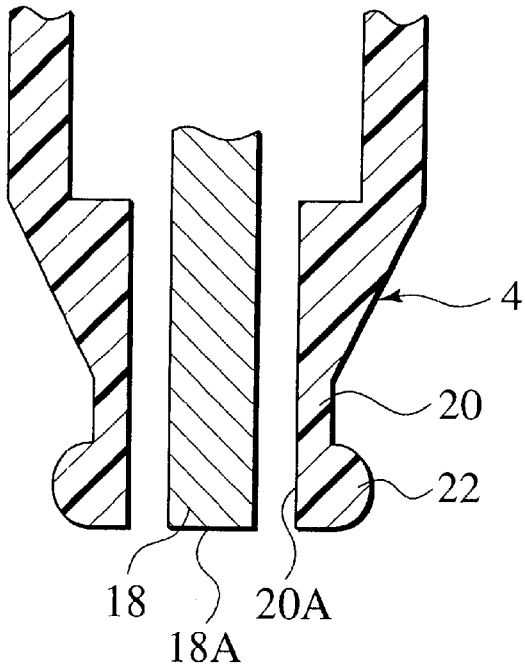
FIG. 2A is a sectional view of a cover and a front ultrasonic horn of the ultrasonic cleaning apparatus in FIG. 1.
Figure 2B:
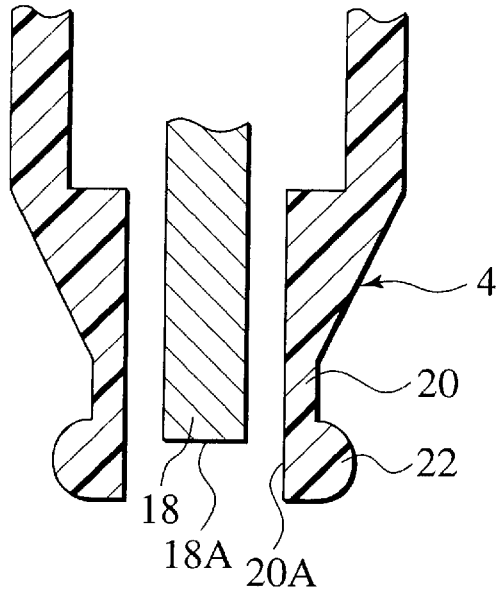
FIG. 2B is a sectional view of a modification of the cover and the horn in FIG. 2A.
Figure 2C:
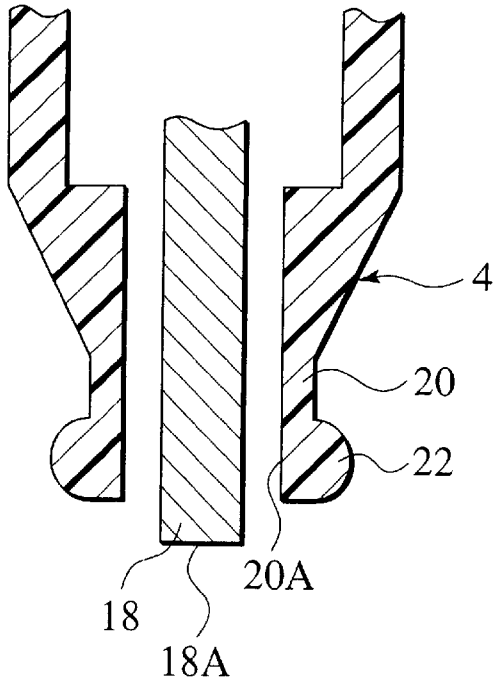
FIG. 2C is a sectional view of another modification of the cover and the horn in FIG. 2A.

In this embodiment, as shown in FIGS. 1 and 2A, the front horn 18 is setat its front end surface 18A substantially flush with the front end of the ring 22. As shown in FIG. 2B, it is also possible to displace the front end surface 18A rearwardly from the front end of the ring 22. When the front end surface 18A of the front horn 18 is protruded from the front end of the covering member 20 by displacement "a", it is preferred that $-5\ mm \leqq a \leqq 10\ mm$. Setting the displacement "a" within the above range enables users to make efficient cleaning without any special skills. More specifically, when the front end of the front horn 18 is protruded from the covering member 20 in the forward direction, there is a fear that users may press the front horn 18 against a cloth surface to be cleaned with too much strength thereby to weaken the ultrasonic vibration of the horn. In this embodiment, the front end of the covering member 20 (the ring 22 in the first embodiment) is applied to the cloth surface, whereby the front end surface 18A of the front horn 18 is prevented from being pressed hard on the cloth surface. In this embodiment, the displacement "a" of the front end of the ultrasonic horn with respect to the cover 4 is set at $-5\ mm \leqq a \leqq 10\ mm$. This ensures a clearance suitable for interposing liquid such as cleaning fluid between the ultrasonic horn and a cleaned article, improving cleaning efficiency. As shown in FIG. 2C, it is within the scope of the present invention to protrude the front end of the front ultrasonic horn 18 from the covering member 20 in the forward direction. In this case, the cover 20 can prevents users from touching the front horn 18.

The cover 4 can be used in either case where any of the above arrangements is fixed or where the arrangement is detachably attached for change. The material of the cover 4 includes thermoplastic resin, thermosetting resin, metal, pulp and ceramics. The material is not limited to those as long as it can attain the object of preventing users from directly touching the front end of the horn, an object of this embodiment.

Now a method of operating the ultrasonic cleaning apparatus 1 and the function/effect thereof will be described.

To initiate the cleaning of, for example, clothes using the ultrasonic cleaning apparatus 1 of this embodiment, a user holding the apparatus body 2 turns the switch 8 on to drive the vibrating section 3. The clothes are immersed in cleaning fluid to be moistened. The ring 22 is applied to a cloth surface of the clothes. The ring 22 is slid on the cloth surface to bring the front end surface 18A of the front horn 18 positively and appropriately into contact with the cloth surface. The front end surface 18A of the front horn 18 transmits ultrasonic vibration through the cleaning fluid to remove stains off the cloth surface.

In the apparatus 1 of this embodiment, the front horn 18 is enclosed by the covering member 20 of the cover 4, which has an effect of preventing the user from directly touching the front horn 18. Further in this embodiment, the ring 22 slides on a cloth surface of clothes, leading the front end surface 18A of the front horn 18 to a prescribed point on the cloth surface.

In this embodiment, it is possible to connect an external power source to a power jack 24 as shown in FIG. 1 instead of a battery to be held in the battery space 6.

Now the result of measurement in effect of cleaning done with the apparatus 1 in various settings including this embodiment will be described.

In this measuring experiment, cylindrical piezoelectric elements (having a diameter of 15 mm and a thickness of 4 mm) with $Pb[Zr\cdot Ti]O_3$, a solid solution of $PbZrO_3$ and $PbTiO_3$, as the main ingredient, the elements being polarized in the thickness direction are employed as the piezoelectric elements 14, 15 as in this embodiment. A Langevin ultrasonic transducer is prepared as the vibrating section 3, the transducer having the piezoelectric elements held between the rear horn 17 and the front horn 18 made of aluminum at torque of 50 kg-cm. The length of the front horn 18 is set at 32.8 mm and the rear horn 17 at 14.3 mm. The diameter of the rear horn is set at 15 mm. The resonant frequency is 50 kHz.

In experimental example A1, in addition to the above arrangements of this embodiment, tolerance in flatness is set at 0.005 mm.

In A2, the front end surface 18A of the front horn 18 in A1 is ground to have a tolerance in flatness of 0.2 mm.

In A3, the area of the front end surface 18A of the front horn 18 in A1 is set at 0.59 $cm^2$, and the ratio between area S1 of the front end surface of the horn and area S2 of the piezoelectric elements, S2/S1, is set at 3.0. However, the resonant frequency is set at 50 kHz as in A1.

In A4, the area of the front end surface 18A of the front horn 18 in A1 is set at 1.75 $cm^2$, S2/S1 is at 1.0, and the tolerance in flatness is at 0.005 mm.

In A5, the front end surface 18A of the front horn 18 in A4 is ground to set the tolerance in flatness at 1.0 mm.

In A6, S1 in A3 is set at 0.71 $cm^2$. S2/S1 is accordingly 2.50. The resonant frequency is set at 50 kHz.

Degree of cleanness is determined by the measurement of light reflectance before and after cleaning with a sample piece of white cotton cloth stained with mud. To the sample piece, a square frame of a 4 cm side is applied to clean mud stains inside the square with the ultrasonic cleaning apparatus. The cleaning is performed for a minute with water continuously poured on the piece. After the cleaning, the sample piece is washed for five minutes, and then dried and ironed. Thereafter light reflectance of the piece is measured with the CM-3500d reflectometer manufactured by Minolta Co., Ltd. Light reflectance is measured for an area in a circle of a diameter of 3 cm.

The rate of cleanness is determined by the following expression:

The rate of cleanness (%)=(light reflectance after cleaning/light reflectance before cleaning)×100.

In this measurement, higher light reflectance indicates higher degree of cleanness. To the ultrasonic transducer 16 consisting of piezoelectric elements 14, 15, an output of 2W, 4W, 8W or 15W is supplied. In A4 and A5, the supply of an output of 50W is attempted. The result of the measurement is shown in FIG. 6. The sample piece in an initial state stained with mud has a right reflectance of 38%.

As apparent from the measurement result shown in FIG. 6, an output of 15W or less, especially 8W or less results in the rate of cleanness of 60% or less when the area of the horn front end surface is about 1.75 $cm^2$ as in A4 and A5, providing insufficient cleaning power. In order to obtain the rate of cleanness of about 80% which provides a high level of satisfaction in cleaning power, it has been found that the area of the horn front end surface should be about 0.6 $cm^2$. When the horn front end surface area is reduced with an output of 8W or less, it has been found that the area of about 0.07 $cm^2$ exerts highly satisfactory cleaning power. Further, in order to obtain a highly satisfactory cleaning power with a lower output of 8W, it has been found that the ratio of area S1 of the horn front end surface and area S2 of the piezoelectric elements, S2/S1, should be 3 or more. As a result, it has been found that in order to perform highly satisfactory cleaning with a low output of 8W or less, it is appropriate to set the front end surface area of the front horn 18 at 0.07 to 1.0 $cm^2$. Further S2/S1 is preferably 3 or more. The words "an output of 8W or less" means a power supplied to the piezoelectric elements, that is, the ultrasonic transducer. The power is preferably from 1W to 8W.

In this embodiment, the front end surface area of the front horn 18 and the value of S2/S1 are set in the above-mentioned range, which provides higher cleaning effect with lower output. This leads to the ultrasonic cleaning apparatus 1 in small size with low energy consumption.

In addition, in order to make this embodiment more effective, FIG. 6 shows that it is preferred that the front horn 18 have a flat front surface and the tolerance in flatness be 0.2 mm or less.

First Modification of the First Embodiment

Figure 7:
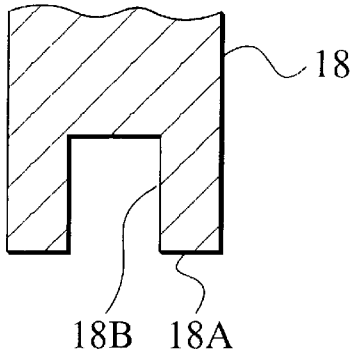
FIG. 7 is a sectional view of the main part of a first modification of the first embodiment.

FIG. 7 shows part of an ultrasonic cleaning apparatus in a first modification of the first embodiment.

The constitution of the modification is different from that of the first embodiment only in the shape of the front end of the front horn 18.

The front end surface 18A of the front horn 18 in this modification has a recess 18B in the center. The area of the front end surface 18A except the recess 18B is set at 0.07 to 1.0 $cm^2$. The ratio of area S1 of the horn front end surface to area S2 of the piezoelectric elements 14, 15, S2/S1, is set at 3 or more.

This structure also provides good cleaning power with a low consumption power of about 8W as in the above embodiment. Further, the increased dimension of the front end of the front horn 18 larger than that of the first embodiment ensures good performance in ultrasonic transmission.

Second Modification of the First Embodiment

Figure 8:
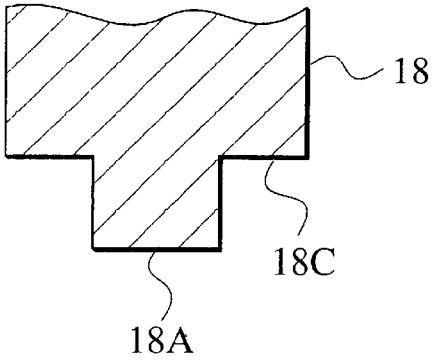
FIG. 8 is a sectional view of the main part of a second modification of the first embodiment.

FIG. 8 shows part of an ultrasonic cleaning apparatus in a second modification of this embodiment. In this modification, a circular portion 18C at the periphery of the front end of the front horn 18 is set backward from the front end surface 18A. The area of the front end surface 18A is set at 0.07 to 1.0 $cm^2$, and S2/S1 is set at 3 or more.

This modification also provides good cleaning power with low consumption power of about 8W as in the first embodiment. Further, the increased size dimension of the front end of the front horn 18 larger than that of the first embodiment ensures good performance in ultrasonic transmission.

Third Modification of the First Embodiment

Figure 9:
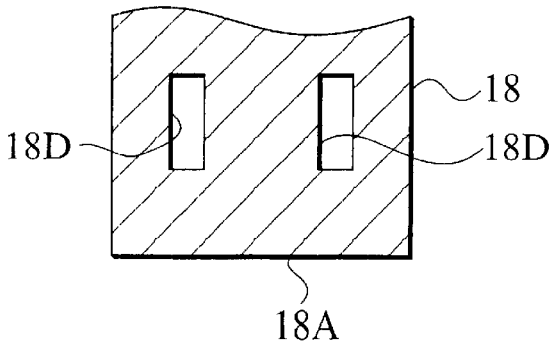
FIG. 9 is a sectional view of the main part of a third modification of the first embodiment.

FIG. 9 shows part of an ultrasonic cleaning apparatus in a third modification of this embodiment. In this modification, the front horn 18 has, for example, a pair of cavities 18D formed in the front part.

Fourth Modification of the First Embodiment

Figure 10:
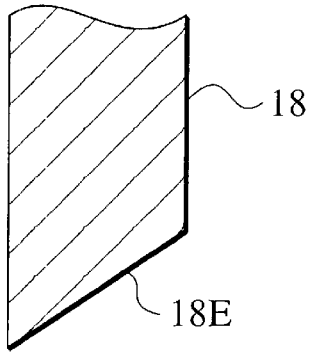
FIG. 10 is a sectional view of the main part of a fourth modification of the first embodiment.

FIG. 10 shows part of an ultrasonic cleaning apparatus in a fourth modification of this embodiment.

In this modification, the front horn 18 has an oblique surface 18E at the front end to reduce the effective area thereof from which ultrasonic vibration is transmitted. Thus the effective area of the front end can be set at 0.07 to 1.0 $cm^2$.

Fifth Modification of the First Embodiment

Figure 11:
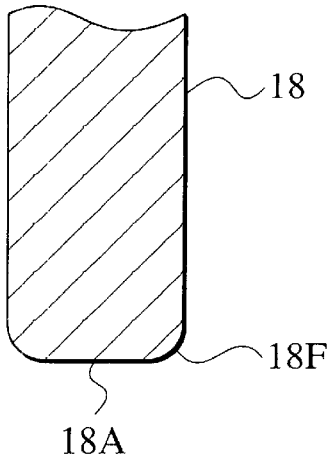
FIG. 11 is a sectional view of the main part of a fifth modification of the first embodiment.

FIG. 11 shows part of an ultrasonic cleaning apparatus in a fifth modification of this embodiment. In this modification, the front horn 18 has a curved surface 18F as an R surface formed at the rim of the front end surface 18A. Forming the curved surface 18F makes it possible to set the area of the front end surface 18A of the front horn 18 smaller than the section area of the front horn 18. Accordingly, the front horn 18 having an area almost identical to that of the piezoelectric elements 14, 15 can be joined with the elements 14, 15 to maintain good performance in ultrasonic transmission while front end surface area S1 can be set easily at 0.07 to 1.0 $cm^2$. Further, the curved surface 18F formed at the front rim of the front horn 18 can prevent hooking of an article being cleaned, being smoothly slid on the article.

The embodiment and the modifications thereof described above are not intended to limit the scope of the present invention. Various modifications are possible within the intended purpose of the structure.

As apparent from the above description, the ultrasonic horn has a flat front end surface and the area of the front end surface is set at 0.07 to 1.0 $cm^2$, which allows driving with low consumption power of 8W or less. This results in a compact ultrasonic cleaning apparatus exerting a sufficient effect in ultrasonic cleaning.

The ratio of the section area of the piezoelectric elements to the front end surface area of the ultrasonic horn is set at 3 or more, which ensures good performance in ultrasonic transmission and improves the efficiency in utilizing ultrasonic vibration at the front end surface. This results in an ultrasonic cleaning apparatus with high cleaning efficiency and low consumption power.

Tolerance of flatness of the front end surface of the ultrasonic horn is set at 0.2 mm or less, which allows a small ultrasonic cleaning apparatus with low consumption power to exert a sufficient effect in ultrasonic cleaning.

Further, the apparatus can be slid smoothly on an article being cleaned.

Second Embodiment

This embodiment has a structure similar to that of the first embodiment. Like elements are given like reference characters and are not described in detail.

Figure 12:
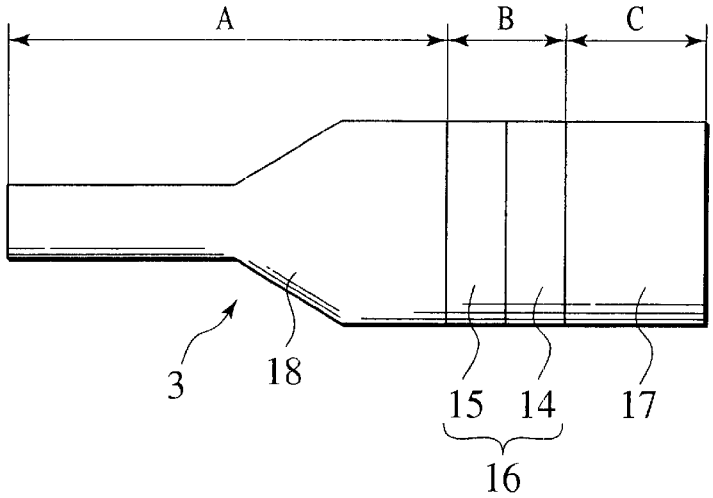
FIG. 12 is a side view of an ultrasonic vibrating section used in a second embodiment.
Figure 14:
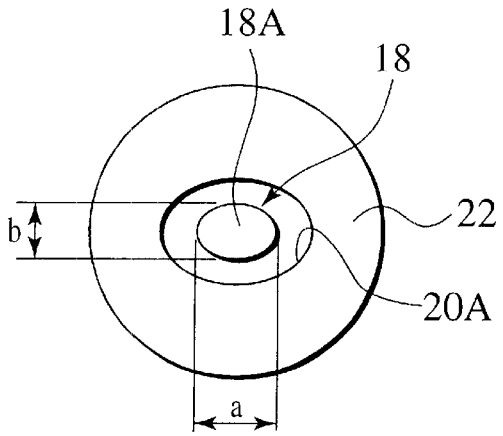
FIG. 14 is a front view of a cover and a front horn of an ultrasonic cleaning apparatus according to a third embodiment.
Figure 15:
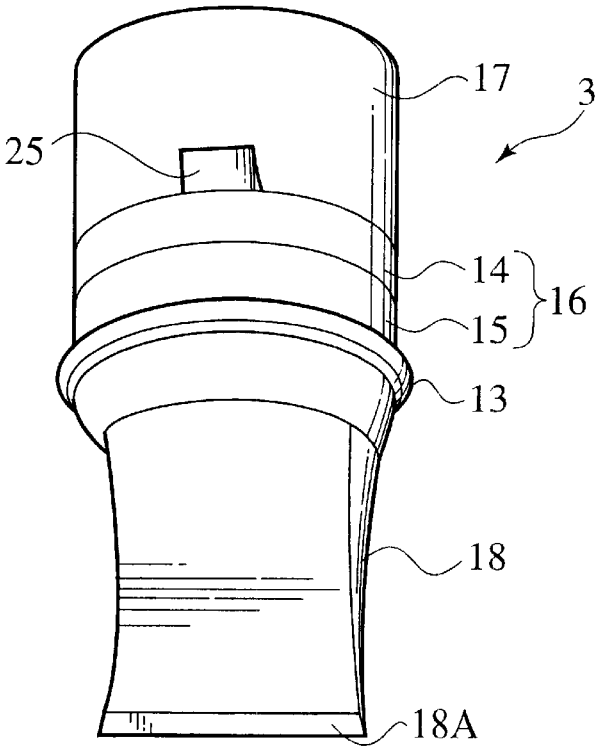
FIG. 15 is a perspective view of an ultrasonic vibrating section in the third embodiment.

As shown in FIG. 12, length A of the front horn 18 is set at 33 mm, length B of the transducer 16 is set at 8 mm and length C of the rear horn 17 is set at 16 mm, for example. The diameter of the rear horn 17 is set at 15 mm, the same as the piezoelectric elements 14, 15. Area S1 of the front end surface of the front horn 18 is set at 0.3 $cm^2$ and area S2 of the piezoelectric elements is set at 1.77 $cm^2$. As a result, in this embodiment, the ratio of S2 to S1, S2/S1, is set at 5.9.

This embodiment provides efficient cleaning with a low consumption power of 8W or less. Further, in this embodiment, the apparatus can exert good cleaning power over a wider range of ultrasonic vibration frequencies. Thus the lower consumption power of the ultrasonic transducer 16 is attained, which makes it possible to make the ultrasonic transducer 16 and the power source smaller and to make the apparatus usable in homes.

Now the result of measurement of the effect of cleaning with the ultrasonic cleaning apparatus in various settings with respect to this embodiment will be described.

In the measurement of the degree of cleanness, the ultrasonic cleaning apparatus 1 with the vibrating section 3 in different settings is used to perform cleaning experiments described below by supplying an output of 8W to the transducer 16.

The structure in experimental example B1 is the same as that of this embodiment, and length A of the front horn 18 is set at 33 mm, length B of the transducer 16 at 8 mm and length C of the rear horn 17 at 16 mm. The front horn 18 and the rear horn 17 are both made of aluminum. S1 of the front horn 18 is set at 0.3 $cm^2$ and S2 of the piezoelectric elements at 1.77 $cm^2$ to make S2/S1 5.9.

The resonant frequency is set at 50 kHz.

In B2, A is set at 23 mm, B is at 8 mm and C is at 7.5 mm in the structure of B1. The front horn 18 and the rear horn 17 are both made of aluminum. As in B1, S1 is set at 0.3 $cm^2$ and S2 at 1.77 $cm^2$.

The resonant frequency is set at 70 kHz.

In B3, A is set at 39 mm, B at 10 mm and C at 39 mm in the structure of B1. The front horn 18 and the rear horn 17 are both made of aluminum. S1 is set at 1.0 $cm^2$ and S2 at 1.77$cm^2$. As a result, S2/S1 is set at 1.77.

The resonant frequency is set at 58 kHz.

In B4, S1 is set at 0.59 $cm^2$ in the structure of B1. S2/S1 is 3.0.

The resonant frequency is set at 58 kHz.

In B5, A is set at 45 mm, B at 8 mm and C at 45 mm in the structure of B1. The front horn 18 and the rear horn 17 are both made of aluminum. S1 is set at 0.3 $cm^2$ and S2 at 1.77 $cm^2$. As a result, S2/S1 is set at 5.9.

The resonant frequency is set at 42 kHz.

In B6, A is set at 25 mm, B at 10 mm and C at 40 mm in the structure of B1. The front horn 18 and the rear horn 17 are both made of aluminum. S1 is set at 1.0 $cm^2$ and S2 at 1.77 $cm^2$. As a result, S2/S1 is set at 1.77.

The resonant frequency is set at 55 kHz.

The result of measurement in B1 to B6 is shown in FIG. 13.

As apparent from FIG. 13, when cleaning rate of 70% or more is obtained, a relationship of $BC/3A \leqq 10A/(A+B+C) \leqq AB/2C$ is established. Further, when cleaning power of 80% or more is obtained, it has been found that S2/S1 is 3 or more in addition to the above relationship. B1 and B2 meet those relationships. The transducer 16 satisfying those relationships exerts good cleaning power with a low consumption power of 8W, leading to the ultrasonic cleaning apparatus 1 in smaller size.

As shown in the FIG., the conditions of $BC/3A \leqq 10A/(A+B+C) \leqq AB/2C$ and S2/S1 is 3 or more are effective when the resonant frequency is in a 25 to 100 kHz frequency band. At a frequency of 25 kHz or less, the apparatus when practically used produces large vibration noise and causes unpleasant touch. Further, a larger ultrasonic horn is required, which is inappropriate as an apparatus for cleaning stains in spots. Furthermore, at a resonant frequency of 100 kHz or more, it is difficult to raise cleaning power to a desirable value even if the above relationships are satisfied. This is because such higher frequencies cause water to vibrate from a vibration level in its entirety to a cross-linking level, which vibration is not suitable for cleaning.

The embodiment and measurement results in the various settings described above are not intended to limit the present invention. Various modifications are possible within the intended purpose of the structure. For example, although the front horn 18 and the rear horn 17 are made of the same material to have the same property in ultrasonic transmission in this embodiment, the horns can be made of any materials which provide generally similar property in ultrasonic transmission. Here the materials having the generally identical properties in ultrasonic transmission means materials having compositions 90% or more identical. Thus, the front horn 18 and the rear horn 17 are made to have almost identical properties to meet the relationships of $BC/3A \leqq 10A/(A+B+C) \leqq AB/2C$ and S2/S1 is 3 or more, thereby to attempt the improvement of efficiency in ultrasonic cleaning with a low consumption energy of 8W or less. In this connection, materials having different properties in ultrasonic vibration have different speeds in transmitting vibration and therefore are easily unbalanced by vibration. Thus large vibration energy cannot be obtained. In this embodiment, although the front horn 18 and the rear horn 17 are made of aluminum, they can be made of another metal such as stainless steel or alloy. Further, the horns can be made of nonmetallic material such as ceramics including glass, alumina, and zirconia or plastics including polystylene, ABC or bakelite and compounds thereof. The nonmetallic material preferably has a sound wave velocity of 2000m/sec. or more.

As apparent from the above description, setting the relationship in length among the front horn, the transducer and the rear horn and setting the front end surface area at 1.0 $cm^2$ or less allow the apparatus to be driven with a low consumption power of 8w or less. This results in an ultrasonic cleaning apparatus in small size which exerts sufficient performance in ultrasonic cleaning and is easy to be used in homes.

The same material used for the front horn and the rear horn increases precision in applying the above relationships in length.

Nonmetallic material can be used for the horns, which has an effect of providing the ultrasonic transducer having lighter weight.

Third Embodiment

Figure 16:
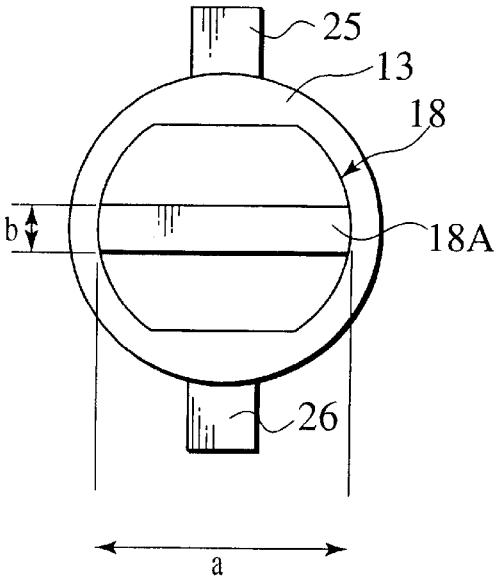
FIG. 16 is a front view of the ultrasonic vibrating section in the third embodiment.
Figure 17:
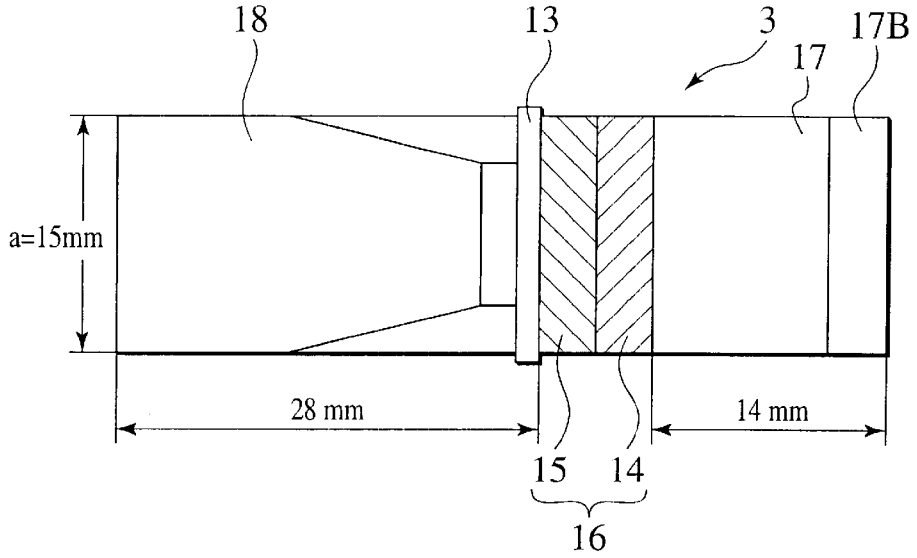
FIG. 17 is a plan view of the ultrasonic vibrating section in the third embodiment.
Figure 18:
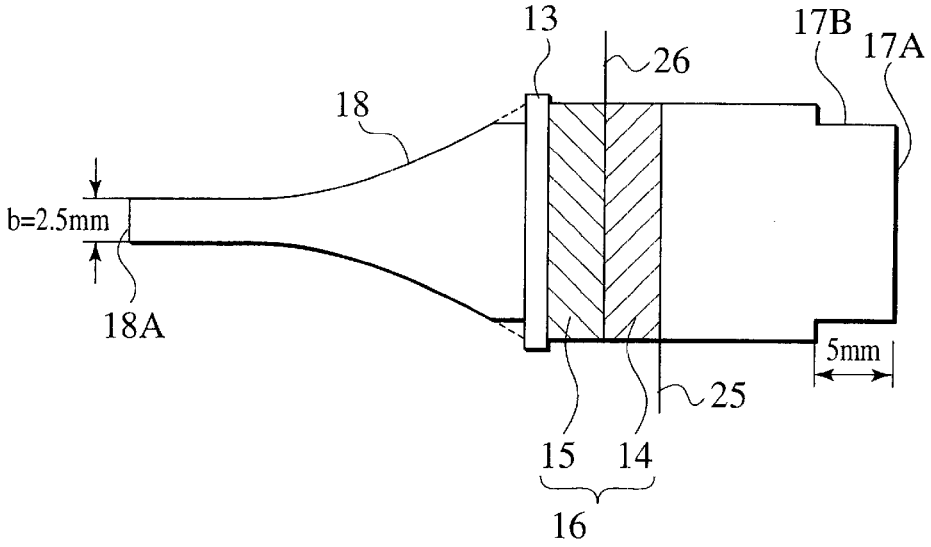
FIG. 18 is a side view of the ultrasonic vibrating section in the third embodiment.

In this embodiment, as shown in FIG. 18, the front horn 18 is configured to be gradually thinner from the proximal end to the front end. As shown in FIG. 16, the front end surface 18A of the front horn 18 to be brought into contact with an article to be cleaned has a narrow rectangular shape. As shown in FIGS. 17 and 18, length "a" of the longer side (major axis) is set at 15 mm, length "b" of the shorter side (minor axis) is at 2.5 mm and the area is at 37.5 $mm^2$. Thus dimension ratio R of the front end surface 18A is a/b=15/2.5, and R is 6.

As shown in FIG. 17, the front horn 18 is set at 28 mm in length and the rear horn at 14 mm. The rear horn 17 is set at 15 mm in diameter, the same as the piezoelectric elements 14, 15. As shown in FIG. 18, the rear horn has stepped parts 17B of 5mm length formed at opposite sides of the rear portion. An output of 6W is supplied to electrodes 25, 26 for the piezoelectric elements. The resonant frequency is 50 kHz.

The cover 4 is not limited in structure to the one shown in the first embodiment. Various modifications are possible.

Now the operation of the ultrasonic cleaning apparatus 1 will be described.

In bringing the front end surface 18A of the front horn 18 into contact with a stain adhered to an article to be cleaned and running (advancing) it on the article, the main axis (longer side) of the front end surface 18A of the front horn 18 is made to form a generally right angle with the running (advancing) direction so as to clean wider area.

Now a method of measuring cleaning effect (cleaning rate) provided by the apparatus 1 in various settings in this embodiment, a method of measuring unevenness of the cleaning rate and the result of the measurement will be described.

The cleaning rate is measured in a method similar to that in experimental example A1. To the ultrasonic transducer 16 including the piezoelectric elements 14, 15, outputs of 4W (in experimental example C3), 6W (in C1) and 8W (in C2, C4 to C9) are supplied. In a reference example, a large output of 50W is supplied.

Unevenness of cleaning rate is measured in the following manner. In measuring the degree of cleanness, an area to be cleaned is expanded to a square of a 10 cm side and is cleaned for the same time period (one minute). In measuring reflectance, 50 parts of a 8 mm diameter within the square are measured. A difference between maximum and minimum percentages in reflectance is used as an unevenness measure. Thus the smaller the difference is, the lower unevenness level is, resulting in good cleaning effect.

In C1, the same structure as that of this embodiment is used.

In C2, length "b" of the minor axis (shorter side) is set at 1.5 mm and dimension ratio R is at 10 in the structure of C1. An output supplied is 8W.

Figure 19:
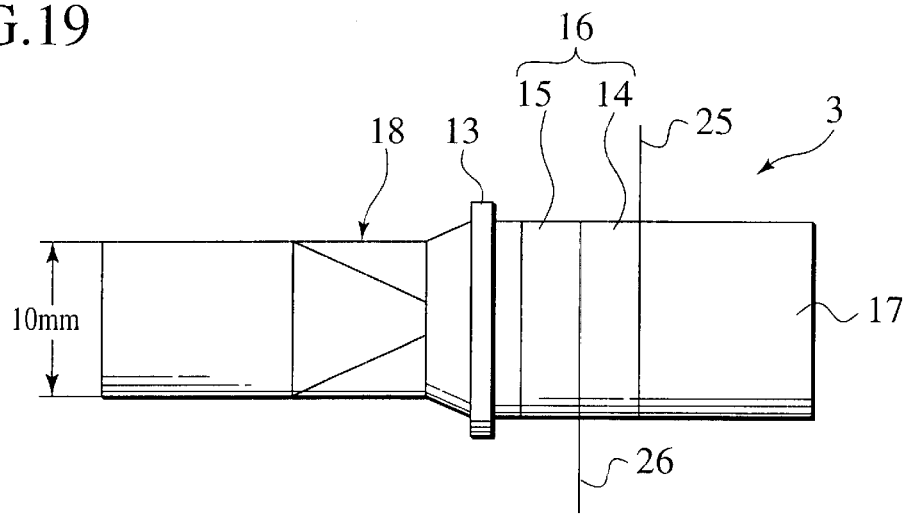
FIG. 19 is a plan view of an ultrasonic vibrating section in experimental example C3.
Figure 20:
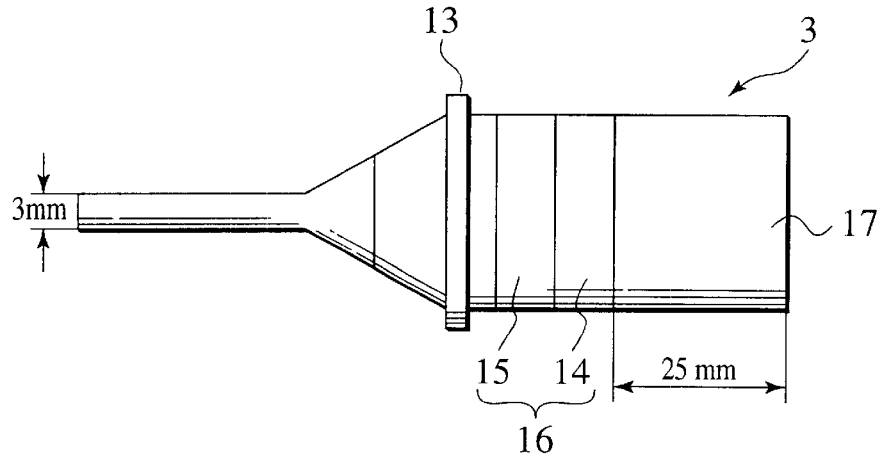
FIG. 20 is a side view of the ultrasonic vibrating section in experimental example C3.
Figure 21:
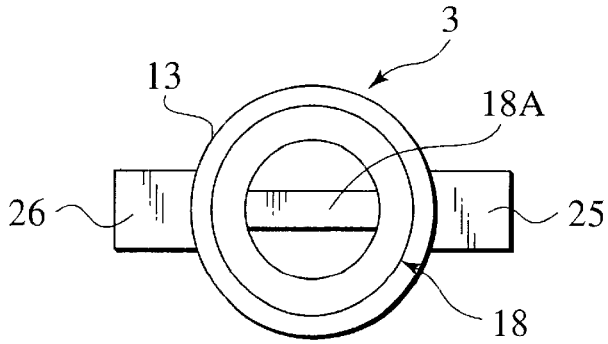
FIG. 21 is a front view of the ultrasonic vibrating section in experimental example C3.

In C3, as shown in FIGS. 19 to 21, main axis length "a" is set at 10 mm and minor axis length "b" is at 3 mm to set R at 3.3, and the front end surface area of the front horn 18 is set at 30 $mm^2$ in the structure of C1. The length of the rear horn 17 is set at 25 mm.

In C4, the diameter of the piezoelectric elements 14, 15 is set at 20 mm and area S2 to be joined to the element 14 is at 314 $mm^2$ in the structure of C1. The main axis length of the front end surface 18A is set at 15 mm, the minor axis length at 2.5 mm and front end surface area S1 is at 37.5 $cm^2$.

In C5, the main axis length is set at 20 mm, the minor axis length is at 6 mm, R is at 3.3 and front surface area S2 is at 120 $mm^2$ in the structure of C4.

In C6, the minor axis length is set at 1.0 mm and dimension ratio R is at 15 in the structure of C1. An output supplied is 8W.

In C7, the front horn 18 has a cylindrical shape of the same diameter (15 mm) as that of the piezoelectric elements 14, 15 in the structure of C1. An output of 8W is supplied.

In C8, the diameter of the elements 14, 15 is set at 25 mm. The front end surface of the front horn 18 has a rectangular shape. The main axis length is set at 25 mm, the minor axis length is at 5 mm, dimension ratio R is at 5, the front end surface area is at 125 $mm^2$, and the output supplied is at 8W.

In C9, the main axis length is set at 30 mm, the minor axis length is at 10 mm, dimension ratio R is at 3, the front end surface are is at 300 $mm^2$, and the output supplied is at 8W in the structure of C1.

In C10, an output of 50W is supplied in the structure of C8.

The result of the measurement is shown in FIG. 22.

As apparent from FIG. 22, C1 to C5 show good results of cleaning rate of 75% or more and unevenness in cleaning rate of 7% or less with a low output of 8W or less. In C1 to C5, dimension ratio R is within the range of $3 \leqq R \leqq 10$, and S1 is 314 $mm^2$ (3.14 $cm^2$) or less, and S2 is within the range of 20 $mm^2 \leqq S2 \leqq 140$ $mm^2$, which is considered to provide good results.

In C6, C7 and C9, since the horn front end surface area is set larger than 140 $mm^2$, it is concluded that energy per unit area is smaller and the cleaning rate is accordingly lowered. In C8, the piezoelectric element area is set at 4.96 $cm^2$, larger than 3.14 $cm^2$, so that the degree of cleanness is lowered and the unevenness in cleaning rate is larger.

From the above results, it is required for an ultrasonic cleaning apparatus drivable with a low output of 8W or less to meet conditions described below.

It is preferred that the front end surface 18A of the front horn 18 be in a rectangular or elliptic shape to have a width to be contacted with an article to be cleaned and dimension ratio R between the minor and major axes be set within the range of $3 \leqq R \leqq 10$.

It is further preferred that S1 be 3.14 $cm^2$ or less and S2 be 20 $mm^2 \leqq S2 \leqq 140$ $mm^2$.

It is still further preferred that the major axis length of the front end surface 18A of the front horn 18 be set at the same or less of that of the piezoelectric elements to be joined with the front horn 18.

The embodiment described above is not intended to limit the present invention. Various modifications are possible within the intended purpose of the structure. For example, although the front end surface 18A of the front horn 18 has a rectangular shape in this embodiment, the surface 18A can have an elliptic shape to provide the same functions/effects.

As apparent from the above description, provided is an ultrasonic cleaning apparatus in a small size which is drivable with a low consumption power and exerts sufficient effect in ultrasonic cleaning.

Efficiency in utilizing ultrasonic vibration at the front end surface is improved to raise cleaning efficiency, resulting in an ultrasonic cleaning apparatus drivable with a low consumption power of 8W or less.

Further, efficiency in generating ultrasonic vibration can be improved.

Furthermore, a housewife safely employs the apparatus in home.

The entire contents of Japanese Patent Applications 2000-129587, 2000-130947 and 2000-131113 (all filed on Apr. 28, 2000) are incorporated herein by reference.

Although the invention has been described above by reference to certain embodiments and their modifications of the invention, the invention is not limited to them. Modifications and variations of the embodiments and modifications described above will occur to those skilled in the art, in light of the above teachings. The scope of the invention is defined with reference to the following claims.

What is claimed is:

1. A portable ultrasonic cleaning apparatus comprising:

a transducer for generating ultrasonic vibrations; and a first horn for transmitting the ultrasonic vibrations, the first horn being joined to one side of the transducer, wherein the transducer has a power consumption set at 8W or less; and the first horn has a front end surface with a first working area (S1) set at 0.07 to 1 $cm^2$.

2. The portable ultrasonic cleaning apparatus as set forth in claim 1, wherein a relationship between a second area (S2) of the one side of the transducer and the first working area (S1) is $S2/S1 \geqq 3$.

3. The portable ultrasonic cleaning apparatus as set forth in claim 1, wherein the front end surface is flat.

4. The portable ultrasonic cleaning apparatus as set forth in claim 1, further comprising:

a guide cover enclosing the first horn.

5. The portable ultrasonic cleaning apparatus as set forth in claim 4, wherein the guide cover includes an end positioned in correspondence with the front end surface, the end having a converged outlet.

6. The portable ultrasonic cleaning apparatus as set forth in claim 5, wherein the front end surface of the first horn extends over the end of the guide cover.

7. The portable ultrasonic cleaning apparatus as set forth in claim 1, wherein a ratio of the power consumption relative to the first working area is set at more than 10 $W/cm^2$.

8. A portable ultrasonic cleaning apparatus comprising:

a transducer for generating ultrasonic vibrations;

a first horn for transmitting the ultrasonic vibrations, the first horn being joined to one side of the transducer; and a second horn joined to another side of the transducer, wherein the transducer has a power consumption set at 8W or less;

the first horn has a front end surface with a first working area (S1) set at 0.07 to 1 $cm^2$; and the first horn of length A, the transducer of length B and the second horn of length C are set in a relationship of $BC/3A \leqq 10A/(A+B+C) \leqq AB/2C$.

9. The portable ultrasonic cleaning apparatus as set forth in claim 8, wherein a relationship between a second working area (S2) of the one side of the transducer and the first working area (S1) is $S2/S1 \geqq 3$.

10. The portable ultrasonic cleaning apparatus as set forth in claim 8, wherein the front end surface has a dimension ratio of R, the dimension ratio R being set within the range of $3 \leqq R \leqq 10$, and the dimension ratio R is the ratio in length of a major axis to a minor axis of the front end surface.

11. The portable ultrasonic cleaning apparatus as set forth in claim 8, wherein the front end surface is flat.

12. The portable ultrasonic cleaning apparatus as set forth in claim 8, further comprising:

a guide cover enclosing the first horn.

13. A portable ultrasonic cleaning apparatus comprising:

a transducer for generating ultrasonic vibrations; and a first horn for transmitting the ultrasonic vibrations, the first horn being joined to one side of the transducer, wherein the transducer has a power consumption set at 8W or less;

the first horn has a front end surface with a first working area (S1) set at 0.07 to 1 $cm^2$;

the front end surface has a dimension ratio of R, the dimension ratio R being set within the range of $3 \leqq R \leqq 10$; and the dimension ratio R is the ratio in length of a major axis to a minor axis of the front end surface.

14. The portable ultrasonic cleaning apparatus as set forth in claim 13, wherein a relationship between a second working area (S2) of the one side of the transducer and the first working area (S1) is $S2/S1 \geqq 3$.

15. The portable ultrasonic cleaning apparatus as set forth in claim 13, wherein the front end surface is flat.

16. The portable ultrasonic cleaning apparatus as set forth in claim 13, further comprising:

a guide cover enclosing the first horn.

* * * * *